US005597641A

United States Patent [19]

Suematsu et al.

[11] Patent Number: 5,597,641

[45] Date of Patent: Jan. 28, 1997

[54] THERMAL TRANSFER MEDIUM

[75] Inventors: Hideki Suematsu; Manabu Ikemoto; Yuriko Kameda, all of Osaka, Japan

[73] Assignee: Fujicopian Co., Ltd., Osaka, Japan

[21] Appl. No.: 381,209

[22] Filed: Jan. 31, 1995

[30] Foreign Application Priority Data

Feb. 19, 1994 [JP] Japan ..... 6-010473

[51] Int. Cl.[6] ..... B41M 5/26; B41M 5/34

[52] U.S. Cl. ..... 428/195; 428/304.4; 428/423.1; 428/424.4; 428/484; 428/913; 428/914

[58] Field of Search ..... 428/195, 484, 428/488.1, 488.4, 913, 914, 304.4, 423.1, 474.4; 503/227

[56] References Cited

U.S. PATENT DOCUMENTS 5,064,807 11/1991 Yoshida et al. ..... 503/227

*Primary Examiner*—B. Hamilton Hess
*Attorney, Agent, or Firm*—Fish & Neave

[57] ABSTRACT

A thermal transfer medium is disclosed which is useful in a method for forming a color image by selectively melt-transferring at least two of a yellow heat-meltable ink layer, a magenta heat-meltable ink layer and a cyan heat-meltable ink layer onto a receptor having a microporous surface layer. The thermal transfer medium includes a foundation having thereon a yellow heat-meltable ink layer, a magenta heat-meltable ink layer and a cyan heat-meltable ink layer, a non-transferable undercoat layer being provided between the foundation and the respective ink layers, each of the ink layers comprising a coloring agent and a vehicle comprising a wax as a major ingredient, each of the ink layers having a melt viscosity of 20 to 200 cps/90 ° C., the undercoat layer comprising a resin exhibiting a strong adhesion to a wax. The thermal transfer medium gives highly fine color images excellent in gradation quality and color reproducibility on the basis of subtractive color mixture of yellow, magenta and cyan.

9 Claims, 6 Drawing Sheets

THERMAL TRANSFER MEDIUM

BACKGROUND OF THE INVENTION

The present invention relates to a thermal transfer medium for use in a method for forming a color image, particularly a multi-color or full-color image by melt-transferring different color heat-meltable a receptor having a microporous surface layer.

Heretofore there has been proposed a method for forming a multi-color image on a receptor having a microporous surface layer wherein a yellow heat-meltable ink layer, a magenta heat-meltable ink layer and a cyan heat-meltable ink layer are selectively melt-transferred in a predetermined order onto the receptor to enter each ink in a molten state into the micropores of the receptor, thereby forming a multi-color image on the basis of subtractive color mixture (Institute of Television Engineers of Japan (ITE) Technical Report, Vol. 17, No. 27, pages 19 to 24 (May, 1993)).

This color image formation method is explained by referring to FIGS. 6 to 8. In FIG. 6, numeral 11 denotes a thermal transfer medium wherein heat-meltable ink layers 13 for respective colors are provided on a foundation 12. Numeral 21 denotes a receptor having a microporous surface layer wherein a multiplicity of micropores 22 are formed in the surface layer (hereinafter referred to as "porous surface receptor" in some cases). The diameter and depth of the micropores 22 are on the order of micrometers. In the porous surface receptor 21 shown in FIG. 6, the micropores 22 are pictured regularly but actual micropores are irregular.

The thermal transfer medium 11 is superimposed onto the receptor 21. The combined thermal transfer medium/receptor is heated from the back side of the thermal transfer medium 11 by means of a thermal head T (in FIG. 6, only one heating element is shown) which is pressed against a platen P, whereby the ink in the heated portion is melted and the molten ink is entered into micropores 22 mainly by capillary action. When the thermal transfer medium 11 is separated from the receptor 21, a color image-bearing receptor 21 is obtained wherein the ink 13*a* is contained in the micropores 22 present in a portion of the receptor 21 which corresponds to the activated heating elements of the thermal head T, as shown in FIG. 7. It should be noted that the condition shown in FIG. 7 is an ideal one and, in fact, such a condition could not be obtained by the prior art, to be described later.

The development of a color, for example, red, on the basis of subtractive color mixture can be achieved by first entering a yellow ink 13Y into micropores 22 and then entering a magenta ink 13M into the micropores 22, thereby superimposing both inks in the respective micropores 22, as shown in FIG. 8. Similarly, green is obtained by a combination of yellow ink and cyan ink; blue is obtained by a combination of magenta ink and-cyan ink; and black is obtained by a combination of yellow ink, magenta ink and cyan ink.

In the aforesaid color image formation method, the density of each color is determined by the amount of the ink for that color contained in the micropores of the receptor. Therefore the method has an advantage that the representation of gradation is possible in every picture element by controlling the amount of each ink heated in transfer.

However, research has not been fully made on the thermal transfer medium for use in the aforesaid color image formation method. The present inventor's research has revealed various problems including the difficulty in entering a predetermined amount of an ink into the micropores.

A serious problem is that as shown in FIG. 9, there occurs a phenomenon that the ink transferred onto the receptor 21 is not sure to get into the micropores 22, hence, a portion of the ink remains in the form of a layer on the surface of the receptor 21 (hereinafter referred to as "excess transfer"). When such an excess transfer which means that a predetermined amount of the ink does not get into the micropores occurs, desired density gradation and subtractive color mixture are not achieved, resulting in poor color reproducibility, and the ink is not transferred in the same area as that of the heating element, resulting in a decrease in resolution.

Another problem is that the obtained image has an uneven gloss. The uneven gloss is caused as follows: When a thermal transfer medium having a heat-meltable ink layer whose vehicle is composed predominantly of a wax is heated to melt the ink layer with a heating element under the condition shown in FIG. 6 and then separated from the receptor, at the time when the ink layer in the heated portion is already solidified, the ink layer in the heated portion is likely to be peeled off from the surface of the foundation of the thermal transfer medium because the ink layer has a poor adhesion against the foundation. In this case, the obtained ink dot has a highly glossy surface. However, the ink layer is not always peeled from the surface of the foundation and in some cases causes peeling at an intermediate face of the ink layer due to internal cohesive failure. In this case, the obtained ink dot has a less glossy surface because of its unevenness as shown in FIG. 10.

Thus, the image contains both highly glossy ink dots and less glossy ink dots, resulting in an unevenness in its gloss.

In view of the foregoing, an object of the present invention is to provide a thermal transfer medium capable of forming a multi-color or full-color image excellent in gradation quality, color reproducibility and fineness without causing the excess transfer or the uneven gloss.

This and other objects of the present invention will become apparent from the description hereinafter.

SUMMARY OF THE INVENTION

The present invention provides a thermal transfer medium for use in a method for forming a color image comprising selectively melt-transferring at least two of a yellow heat-meltable ink layer, a magenta heat-meltable ink layer and a cyan heat-meltable ink in a onto a receptor having a microporous surface layer predetermined order to enter each ink in a molten state into micropores of the receptor, thereby forming a color image comprising (A) at least one color region developed on the basis of subtractive color mixture of at least two of yellow, magenta and cyan, or a color image comprising (A) at least one color region developed on the basis of subtractive color mixture of at least two of yellow, magenta and cyan, and (B) at least one color region of single color selected from yellow, magenta and cyan, the thermal transfer medium comprising a foundation, a non-transferable undercoat layer provided on the foundation, and at least one of a yellow heat-meltable ink layer, a magenta heat-meltable ink layer and a cyan heat-meltable ink layer provided on the undercoat layer, each of the ink layers comprising a coloring agent and a vehicle comprising a wax as a major ingredient, each of the ink layers having a melt viscosity of 20 to 200 cps/90° C., the undercoat layer comprising a resin exhibiting a strong adhesion to a wax.

According to an embodiment of the foregoing thermal transfer medium, the yellow heat-meltable ink layer, the magenta heat-meltable ink layer and the cyan heat-meltable ink layer are disposed in a side-by-side relationship on a single foundation.

The present invention further provides an assembly of plural thermal transfer media for use in a method comprising selectively melt-transferring at least two of a yellow heat-meltable ink layer, a magenta heat-meltable ink layer and a cyan heat-meltable ink layer onto a receptor having a microporous surface layer in a predetermined order to enter each ink in a molten state into micropores of the receptor, thereby forming a color image comprising (A) at least one color region developed on the basis of subtractive color mixture of at least two of yellow, magenta and cyan, or a color image comprising (A) at least one color region developed on the basis of subtractive color mixture of at least two of yellow, magenta and cyan, and (B) at least one color region of single color selected from yellow, magenta and cyan, the assembly comprising a first thermal transfer medium comprising a foundation, a non-transferable undercoat layer provided on the foundation, and a yellow heat-meltable ink layer provided on the undercoat layer, a second thermal transfer medium comprising a foundation, a non-transferable undercoat layer provided on the foundation, and a magenta heat-meltable ink layer provided on the undercoat layer, and a third thermal transfer medium comprising a foundation, a non-transferable undercoat layer provided on the foundation, and a cyan heat-meltable ink layer provided on the undercoat layer, each of the ink layers comprising a coloring agent and a vehicle comprising a wax as a ingredient, each of the ink layers having a melt viscosity of 20 to 200 cps/90° C., each of the undercoat layers comprising a resin exhibiting a strong adhesion to a wax.

DETAILED DESCRIPTION

Figure 1:
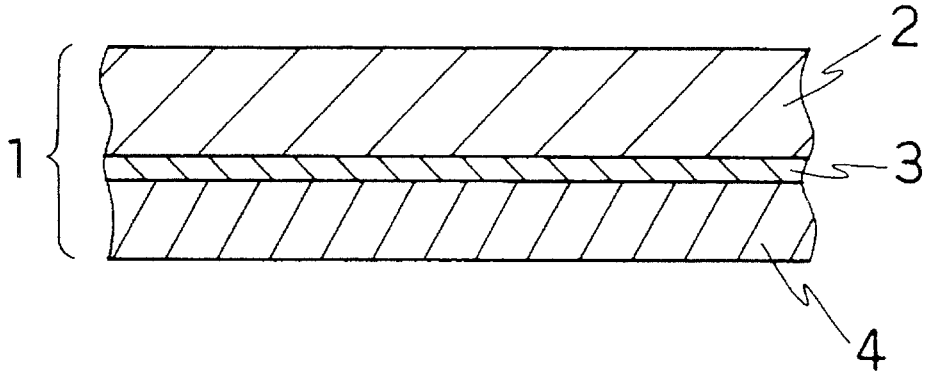
FIG. 1 is a schematic partial sectional view showing an example of the thermal transfer medium of the present invention.

The present invention will be explained by referring to the drawings.

FIG. 1 is a schematic partial sectional view showing an example of the thermal transfer medium of the present invention.

Numeral 1 denotes a thermal transfer medium. The thermal transfer medium 1 comprises a foundation 2, a non-transferable undercoat layer 3 provided on the foundation 2 and comprising a resin exhibiting a good adhesion to a wax, and a heat-meltable ink layer 4 provided on the undercoat layer 3 and which comprises a wax as a major component of its vehicle and has a low melt viscosity. The heat-meltable ink layer 4 is an ink layer of a single color selected from yellow, magenta, cyan and black.

Figure 2:
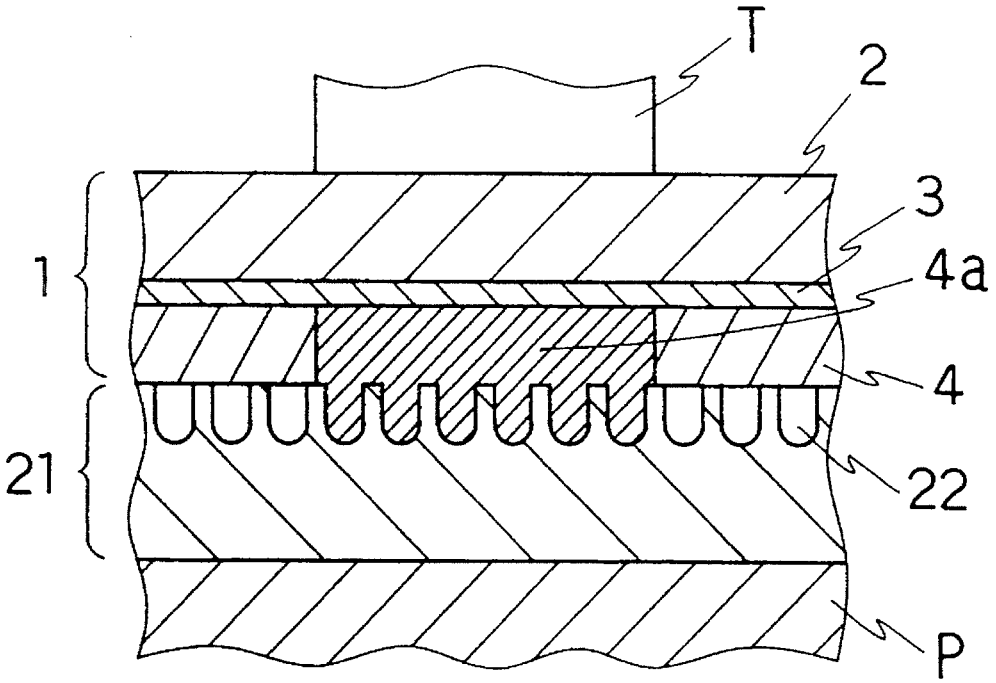
FIG. 2 is a schematic sectional view showing a color image formation method using a thermal transfer medium in accordance with the present invention.

As shown in FIG. 2, the thermal transfer medium 1 is superimposed on a porous surface receptor 21. The combined thermal transfer medium/receptor is heated from the back side of the thermal transfer medium 1 by means of a thermal head T (in FIG. 2, only one heating element is shown) which is pressed against a platen P, whereby the molten ink *4a* is entered into micropores 22 present in a portion of the receptor 21 which corresponds to the activated heating elements of the thermal head T. In that case, by virtue of the specified melt viscosity, a predetermined amount of the ink is sure to enter the micropores.

Figure 3:
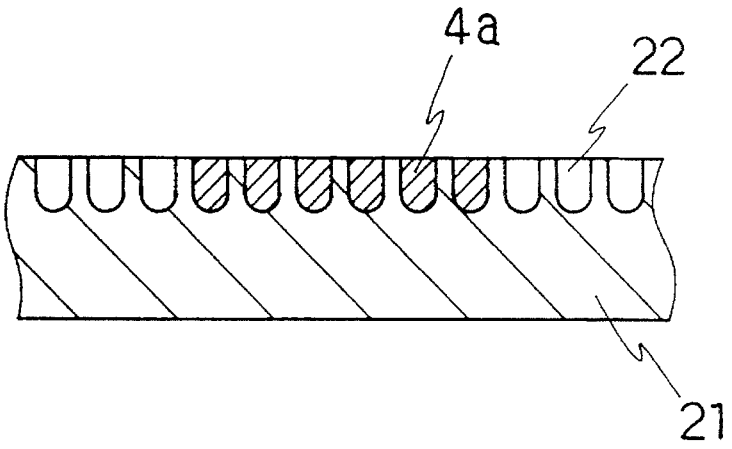
FIG. 3 is a schematic partial sectional view showing a porous surface receptor wherein a color image is formed according to the foregoing color image formation method.

Thereafter, when the thermal transfer medium 1 is separated from the receptor 21, at the time when the ink *4a* in the heated portion is already solidified, the ink *4a* is peeled off from the thermal transfer medium 1 at the interface between the ink layer and the receptor 21 (i.e. the surface of the receptor 21) because the adhesion between the ink *4a* and the undercoat layer 3 is strong. Thus there is obtained the receptor 21 wherein the ink *4a* is contained in the micropores 22 and no ink in the form of a layer is present on the surface thereof, as shown in FIG. 3.

As described above, in the case of forming a color image on the porous surface receptor with use of the thermal transfer medium of the present invention, the ink in the heated portion is always peeled off from the thermal transfer medium at the interface between the ink layer and the receptor because of the strong adhesion of the ink layer to the undercoat layer when the thermal transfer medium is separated from the receptor. As a result the excess transfer does not occur and the resulting image has a uniform gloss without unevenness of gloss.

In accordance with the invention, by virtue of the above mechanism, a highly fine image with a high resolution can be obtained and a predetermined amount of the ink can be entered into micropores of the porous surface receptor by control of the amount of heat generated from the heating element, providing excellent gradation quality. Moreover, in the formation of a color image by subtractive color mixture of yellow, magenta and cyan, it is possible to superimpose predetermined amounts of different color inks in the respective micropores. This, coupled with the excellent gradation quality, provides a highly fine color image with excellent color reproducibility.

The present invention will be explained more specifically.

In the thermal transfer medium of the present invention, a non-transferable undercoat layer composed of a resin exhibiting a good adhesion to waxes is interposed between the foundation and the heat-meltable ink layer.

Preferable as the resin for the undercoat layer are polyurethane resins, polyamide resins, and the like, from the viewpoint that these resins exhibit a good adhesion to the foundation, typically, polyester film, as well as waxes. These resins can be used singly or in combination.

Any of usual soft polyurethane resins can be used as the polyurethane resin for the undercoat layer without any particular limitation, including those prepared by reacting a diol component and a diisocyanate component, and those prepared by reacting a urethane prepolymer having isocyanate groups at both ends thereof (the prepolymer is obtained by reacting a diol component and a diisocyanate component ) with a chain extender. Examples of the diol component are polyester diols, polyether diols and polyester-polyether diols. Examples of the diisocyanate component are tolylenediisocyanate, diphenylmethanediisocyanate, hexamethylenediisocyanate and isophoronediisocyanate. Examples of the chain extender are diamines such as hexamethylendiamine, 4,4'-diaminodiphenylmethane and isophoronediamine, and diols such as ethylene glycol, propylene glycol and 1,4-butanediol.

Among the foregoing polyurethane resins, polyester type polyurethane resins exhibit a good adhesion especially to a foundation such as polyester film, and polyether type polyurethane resins exhibit a good adhesion especially to waxes. Accordingly, in the present invention, there is more preferably used a mixture of a polyester type polyurethane resin and a polyether type polyurethane resin, thereby providing a good adhesion between the undercoat layer and the foundation and a good adhesion between the undercoat layer and the ink layer. Thus the excess transfer or the uneven gloss can be more satisfactorily prevented. In that case, the proportion of the polyester type polyurethane resin and the polyether type polyurethane resin (in the case of the polyesterpolyether type polyurethane resin, the proportion of the polyester diol and the polyether diol) ranges preferably from 10 to 300 parts (parts by weight, hereinafter), more preferably 50 to 200 parts, still more preferably 70 to 120 parts of the polyether type polyurethane resin relative to 100 parts of the polyester type polyurethane resin from the viewpoint of obtaining a better combination effect.

Any of the usual thermoplastic polyamide resins having a relatively low molecular weight can be used as the polyamide resin for the undercoat layer without any particular limitation. In particular, copolycondensation products of dimer acid with a polyamine and a diamine are preferable.

Generally polyurethane resins and polyamide resins exhibit strong tackiness. In a step of coating an undercoat layer composed of a polyurethane resin or a polyamide resin formed on a foundation with an ink layer, the problem sometimes occurs that the undercoat layer sticks to the rolls of a coater due to its tackiness, so that coating of an ink becomes difficult. In that case, it is preferable to control the tackiness of the undercoat layer by incorporating a filler thereinto.

Usable as the filler incorporated into the undercoat layer as required are particulate materials such as carbon black, titanium oxide and silica. When the filler is incorporated into the undercoat layer, the content of the filler in the undercoat layer is preferably from 5 to 85% (% by weight, hereinafter the same), more preferably from 15 to 35%. When the content of the filler is less than the above range, it is difficult to satisfactorily control the tackiness of the undercoat layer. When the content of the filler is more than the above range, the adhesion between the undercoat layer and the foundation or the adhesion between the undercoat layer and the ink layer is prone to be reduced due to the decreased proportion of the resin.

The undercoat layer may be further incorporated with auxiliary agents such as dispersing agent, as required. The undercoat layer may be crosslinked to a low crosslinking density by addition of a crosslinking agent such as isocyanate compound.

The undercoat layer preferably has a softening temperature of not lower than 80° C. and higher than the softening temperature of the ink layer.

From the viewpoints of heat conduction and the like, the undercoat layer preferably has as thin a thickness as possible, as far as it exhibits the desired effects. Usually, the coating amount (on a solid basis, hereinafter the same) of the undercoat layer is from 0.1 to 2 $g/m^2$, preferably from 0.5 to 1.0 $g/m^2$.

The undercoat layer can be formed by applying onto a foundation a coating liquid prepared by dissolving or dispersing into an appropriate solvent the aforesaid polyurethene resin and/or polyamide resin, and optionally the filler and other additive, followed by drying.

The heat-meltable ink layers for respective colors used in the present invention are each composed of a coloring agent and a heat-meltable vehicle which is composed predominantly of a wax and optionally a heat-meltable resin. Each ink layer has a low melt viscosity of 20 to 200 cps/90° C. The content of the wax in the heat-meltable vehicle is preferably 70 to 100%.

Examples of specific waxes include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, α-olefin-maleic anhydride copolymer wax, urethane wax and Fischer-Tropsch wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and besamides such as oleic acid amide. These waxes may be used either alone or in combination.

Examples of specific heat-meltable resins include ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-stryene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, polymer, petroleum resins, rosin resins, terpene resins and cumarone-indene resins. These resins may be used either alone or in combination.

The coloring agents for yellow, magenta and cyan for the ink layers are preferably transparent ones.

Examples of specific transparent coloring agents for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These coloring agents may be used either alone or in combination.

Examples of specific transparent coloring agents for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These coloring agents may be used either alone or in combination.

Examples of specific transparent coloring agents for cyan include organic pigments such as Victoria Blue Lake, metal-free Phthalocyanine Blue, Phthalocyanine Blue and Fast Sky Blue; and dyes such as such as Victoria Blue. These coloring agents may be used either alone or in combination.

The term "transparent pigment" is herein meant by a pigment which gives a transparent ink when dispersed in a transparent vehicle.

If the subtractive color mixture utilizing superimposing of the three colors, yellow, magenta and cyan, can hardly give a clear black color, there may be further used a black ink layer containing a coloring agent for black such as carbon black, Nigrosine Base or the like. The black ink layer for this purpose is not adapted for the superimposing with other color ink layer and, hence, need not be necessarily transparent. Nevertheless, the black ink layer is preferably transparent for the purpose of giving a desired color such as blue black by the superimposing with other color ink layer.

The content of the coloring agent in the heat-meltable ink layer for each color is preferably about 5 to about 60% by weight.

The heat-meltable ink layer may be incorporated, in addition to the above ingredients, with a dispersant, an antistatic agent and other additives, as required.

In the present invention, each of the heat-meltable ink layers for respective colors is specified to have a melt viscosity within the range of 20 to 200 cps/90° C., in order to ensure the entrance of a predetermined amount of each ink into the micropores present in an area of the receptor which corresponds to the activated heating element. When the melt viscosity of each of the ink layers for respective colors is higher the above range, it is difficult to enter a predetermined amount of the ink into the micropores of the receptor. When the melt viscosity is lower than the above range, the ink spreads so that picture elements are jointed to each other, resulting in a decrease of resolution.

The melting point of the heat-meltable ink layer is preferably from about 60° to about 85° C. When the melting point is lower than 60° C., the storage property of the thermal transfer medium is prone to degrade. When the melting point is higher than 85° C., the transfer sensitivity is prone to degrade.

The coating amount of each of the ink layers for respective colors is preferably from 0.5 to 2.5 g/m$^2$, from the viewpoint of ensuring a desired reflection density for printed images, a desired number of gradations and a desired subtractive color mixture.

The thermal transfer medium for color image formation in accordance with the present invention is one wherein the heat-meltable ink layers for respective colors are provided on a foundation or foundations. The yellow ink layer, the magenta ink layer and the cyan ink layer and optionally the black ink layer may be disposed either on separate foundations, respectively, as shown in FIG. 1, or on a single foundation in a side-by-side relationship.

Figure 4:
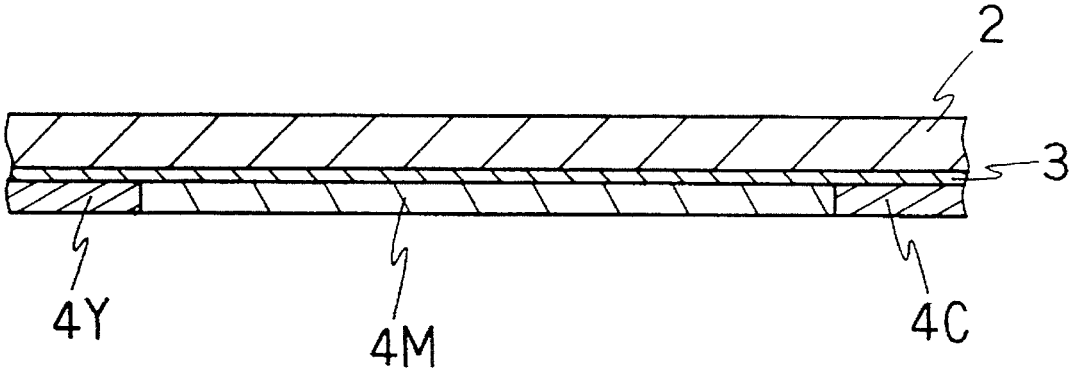
FIG. 4 is a schematic partial sectional view showing another example of the thermal transfer medium of the present invention.
Figure 5:
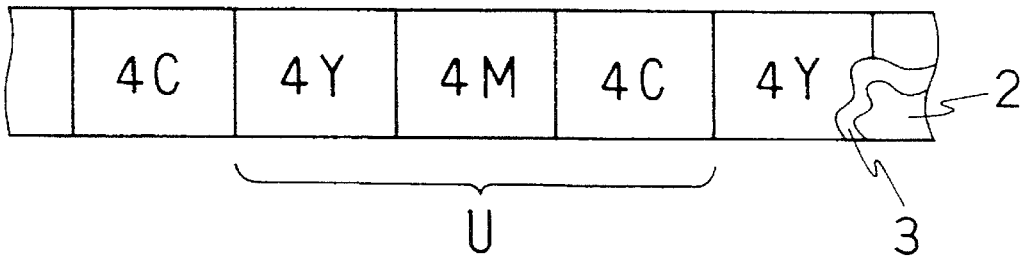
FIG. 5 is a partial plan view showing the example shown in FIG. 4.
Figure 6:
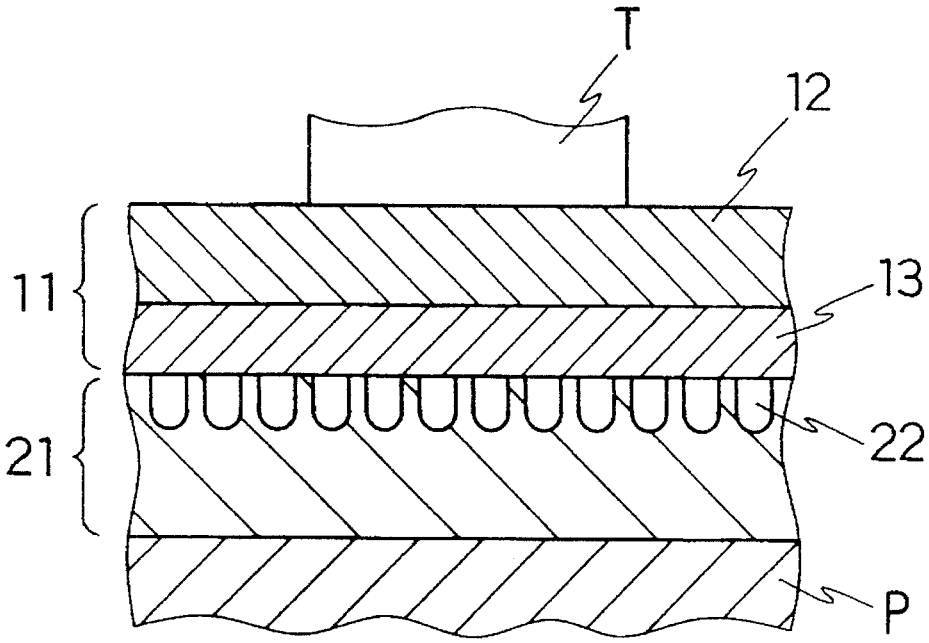
FIG. 6 is a schematic sectional view showing a color image formation method using a conventional thermal transfer medium.
Figure 7:
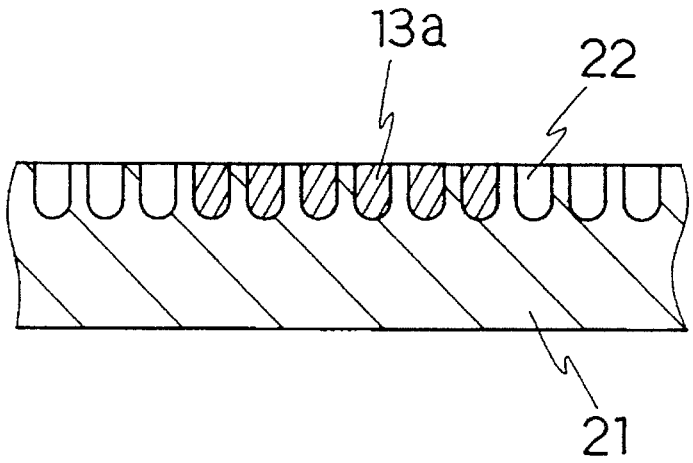
FIG. 7 is a schematic sectional view showing a porous surface receptor wherein a color image is formed.

FIG. 4 is a schematic partial sectional view illustrating an example of a thermal transfer medium wherein the ink layers for respective colors are disposed on a single foundation in a side-by-side relationship. FIG. 5 is a partial plan view showing the example of FIG. 4. In FIGS. 4 and 5, an undercoat layer 3 is provided on a continuous foundation 2, and a yellow ink layer 4Y, a magenta ink layer 4M and a cyan ink layer 4C, each of which preferably has a predetermined constant size, are periodically repeatedly disposed in a side-by-side relationship on the undercoat layer 3 in a repeating unit U comprising the ink layers Y, M and C arranged in a predetermined order. The order of arrangement of these three color ink layers in the repeating unit U can be suitably determined in consideration of the order of superimposing the ink layers for respective colors, or the like. A black ink layer may be included in the repeating unit U.

Alternatively the yellow ink layer, the magenta ink layer and the cyan ink layer and optionally the black ink layer may be disposed in a side-by-side relationship on a single foundation in a stripe form along the longitudinal direction of the foundation with the interposed between the foundation undercoat layer being and the ink layers.

Usable as the foundation for the thermal transfer medium of the present invention are polyester films such as polyethylene terephthalate film, polyethylene naphthalate film and polyarylate film, polycarbonate films, polyamide films, aramid films and other various plastic films commonly used for the foundation of ink ribbons of this type. Thin paper sheets of high density such as condenser paper can also be used.

On the back side (the side adapted to come into slide contact with a thermal head) of the foundation may be formed a conventionally known stick-preventive layer. Examples of the materials for the stick-preventive layer include various heat-resistant resins such as silicone resin, fluorine-containing resin and nitrocellulose resin, and other resins modified with these heat-resistant resins such as silicone-modified urethane resins and silicone-modified acrylic resins, and mixtures of the foregoing heat-resistant resins and lubricating agents.

The thickness of the foundation is usually from about 1 to about 10 μm. From the viewpoint of suppressing heat spreading to increase resolution, the thickness of the foundation is preferably in the range of 1 to 4.5 μm.

The formation of a color image with use of the thermal transfer medium of the present invention is preferably performed as follows: With use of a thermal transfer printer, the yellow ink layer, the magenta ink layer and the cyan ink layer are selectively melt-transferred onto a porous surface receptor in a predetermined order according to separation color signals of an original color image, i.e. yellow signals, magenta signals and cyan signals to enter the inks into micropores of the receptor. The order of transfer of the yellow ink layer, the magenta ink layer and the cyan ink layer can be determined as desired. When a usual full-color or multi-color image is formed, all the three color ink layers are selectively transferred according to three color signals to form three color separation images, i.e. a yellow separation image, a magenta separation image and a cyan separation image on the receptor. When only two color signals are present, the corresponding two of the three color ink layers are selectively transferred to form two color separation images of a yellow separation image, a magenta separation image and a cyan separation image.

Figure 8:
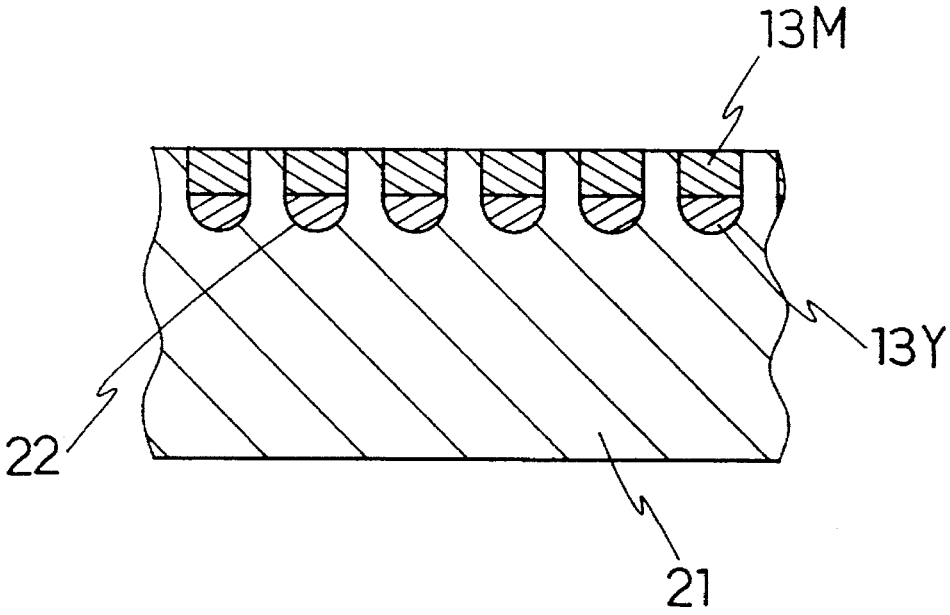
FIG. 8 is a schematic partial sectional view showing a porous surface receptor wherein a color image composed of a yellow ink and a magenta ink superimposed one on another is formed.
Figure 9:
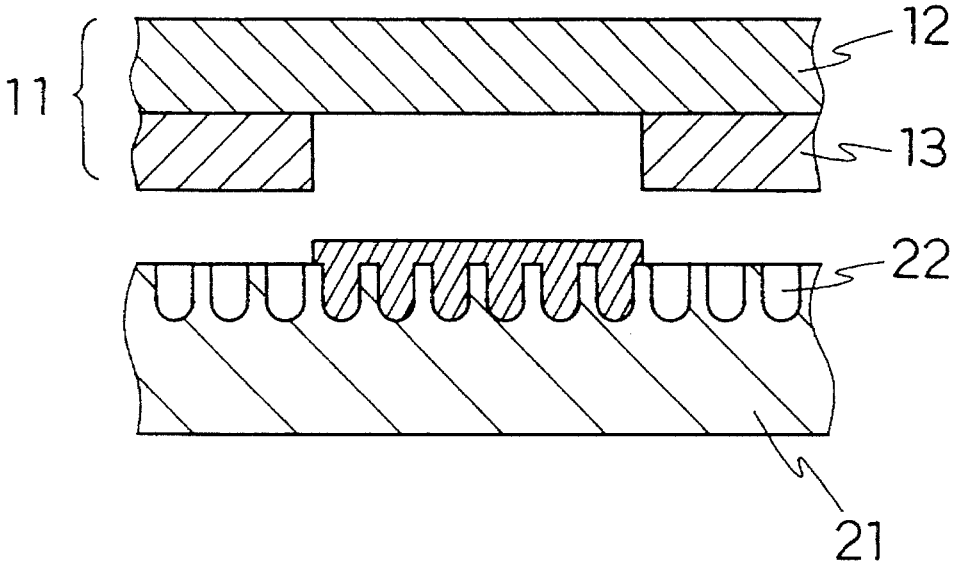
FIG. 9 is a schematic sectional view illustrating an excess transfer phenomenon which occurs in the conventional method.
Figure 10:
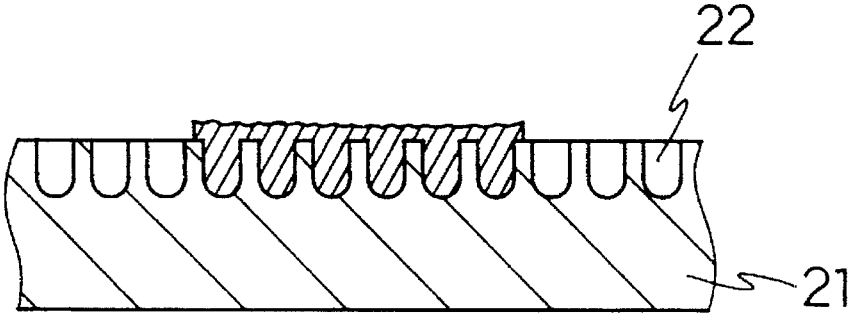
FIG. 10 is a schematic sectioned view for explanating the reason why an uneven gloss occurs in color images obtained in the conventional method.

Thus there is obtained a color image comprising (A) at least one color region wherein a color is developed by virtue of subtractive color mixture of at least two superimposed inks of yellow, magenta and cyan, as illustrated in FIG. 8, or a color image comprising a combination of (A) at least one color region wherein a color is developed by virtue of subtractive color mixture of at least two superimposed inks of yellow, magenta and cyan and (B) at least one region of single color selected from yellow, magenta and cyan wherein different color inks are not superimposed. Herein a region where the yellow ink and the magenta ink are present in the micropores develops a develops a red color; a region where the yellow ink and the cyan ink are present in the micropores develops a green color; a region where the magenta ink and the cyan ink are present in the micropores develops a blue color; and a region where the yellow ink, the magenta ink and the cyan ink are superimposed in the micropores develops a black color. A region where only the yellow ink, the magenta ink or the cyan ink is present in the micropores develops a yellow color, a magenta color or a cyan color.

In the above manner, a black color is obtained by the superimposing of the yellow ink, the magenta ink and the cyan ink. However, a black color may be obtained by using only the black ink instead of using the three color inks.

Gradation colors (half tone colors) for each color can be obtained by controlling the amount of each color ink transferred so that the mount of each color ink entering the micropores is adjusted.

Usable as the porous surface receptor for use in the color image formation using the thermal transfer medium of the present invention is one disclosed in Japanese Unexamined Patent Publication No. 41287/1990. The porous surface receptor is prepared as follows: Two or more kinds of resins which are immiscible or less miscible with each other (for example, a combination of a homopolymer or copolymer of vinyl chloride and a homopolymer or copolymer of acrylonitrile) are dissolved into a solvent. The solution is applied onto a film substrate such as polypropylene film or polyester film. The resultant is passed through a liquid which is miscible with the solvent and incapable of dissolving the resins, thereby coagulating the resins, followed by drying. Thus a porous resinous layer is formed on the film substrate. The porous resinous layer is brought into contact with a smooth sheet material which is incompatible with the porous resinous layer and subjected to a heating treatment under a pressure to give a receptor having a porous surface layer containing a multiplicity of micropores.

The porous surface layer preferably has an average pore diameter of 0.1 to 10 μm, especially 0.5 to 5 μm, an average pore depth of 0.5 to 15 μm, especially 2 to 10 μm, and an average pore density (an average number of pores per unit area) of $5\times10^5$ to $1\times10^7/mm^2$.

The present invention will be more fully described by way of Examples. It is to be understood that the present invention is not limited to the Examples, and various change and modifications may be made in the invention without departing from the spirit and scope thereof.

EXAMPLES 1 TO 4

Onto one side of a 3.5 μm-thick polyethylene terephthalate film which was provided on the other side thereof with a 0.1 μm-thick stick-preventing layer composed of a silicone-modified urethane resin was applied the coating liquid for undercoat layer shown Table 1, followed by drying at 60° C. to give an undercoat layer having a coating amount of 0.8 $g/m^2$. Onto the undercoat layer were applied the inks for respective colors each having the composition shown in Table 2 by hot-melt coating to give a thermal transfer medium wherein the ink layers for respective colors were arranged as shown in FIGS. 4 and 5.

COMPARATIVE EXAMPLE

The same procedures as in Examples 1 to 4 except that the undercoat layer was not provided on the foundation and the ink layers were directly formed on the foundation were repeated to give a thermal transfer medium.

TABLE 1

| | Ex. 1 | Ex. 2 | Ex. 3 | Ex. 4 |
|---|---|---|---|---|
| Polyester type polyurethane resin (softening point: 120° C.) | 4 | 4 | — | 4 |
| Polyether type polyurethane resin (softening point: 90° C.) | 3 | 3 | — | 3 |
| Polyamide resin (softening point: 90° C.) | — | — | 7 | — |
| Carbon black | 2.5 | — | — | — |
| Silica powder | — | 2.5 | 2.5 | — |
| Dispersing agent | 0.5 | 0.5 | 0.5 | — |
| Toluene | 40 | 40 | 40 | 43 |
| Methyl ethyl ketone | 50 | 50 | 50 | 50 |

TABLE 2

| | Yellow ink layer | Magenta ink layer | Cyan ink layer |
|---|---|---|---|
| Formula (parts by weight) | | | |
| Paraffin wax | 60 | 60 | 60 |
| Carnauba wax | 20 | 20 | 20 |
| Ethylene-vinyl acetate copolymer | 5 | 5 | 5 |
| Pigment Yellow | 15 | — | — |
| Carmine 6B | — | 15 | — |
| Cyanine Blue KRO | — | — | 15 |
| Coating amount ($g/m^2$) | 1.5 | 1.5 | 1.5 |
| Melting point (°C.) | 72 | 72 | 72 |
| Melt viscosity (cps/90° C.) | 140 | 140 | 140 |

In the production of the thermal transfer medium of Example 4, the undercoat layer was apt to stick to rolls of the coater in the step of forming ink layers on the undercoat layer. No troubles occurred in Examples 1 to 3.

With use of each of the thus obtained thermal transfer media in a thermal transfer printer specified below, printing was conducted on a porous surface receptor specified below to evaluate gradation quality and resolution.

Figure 11:
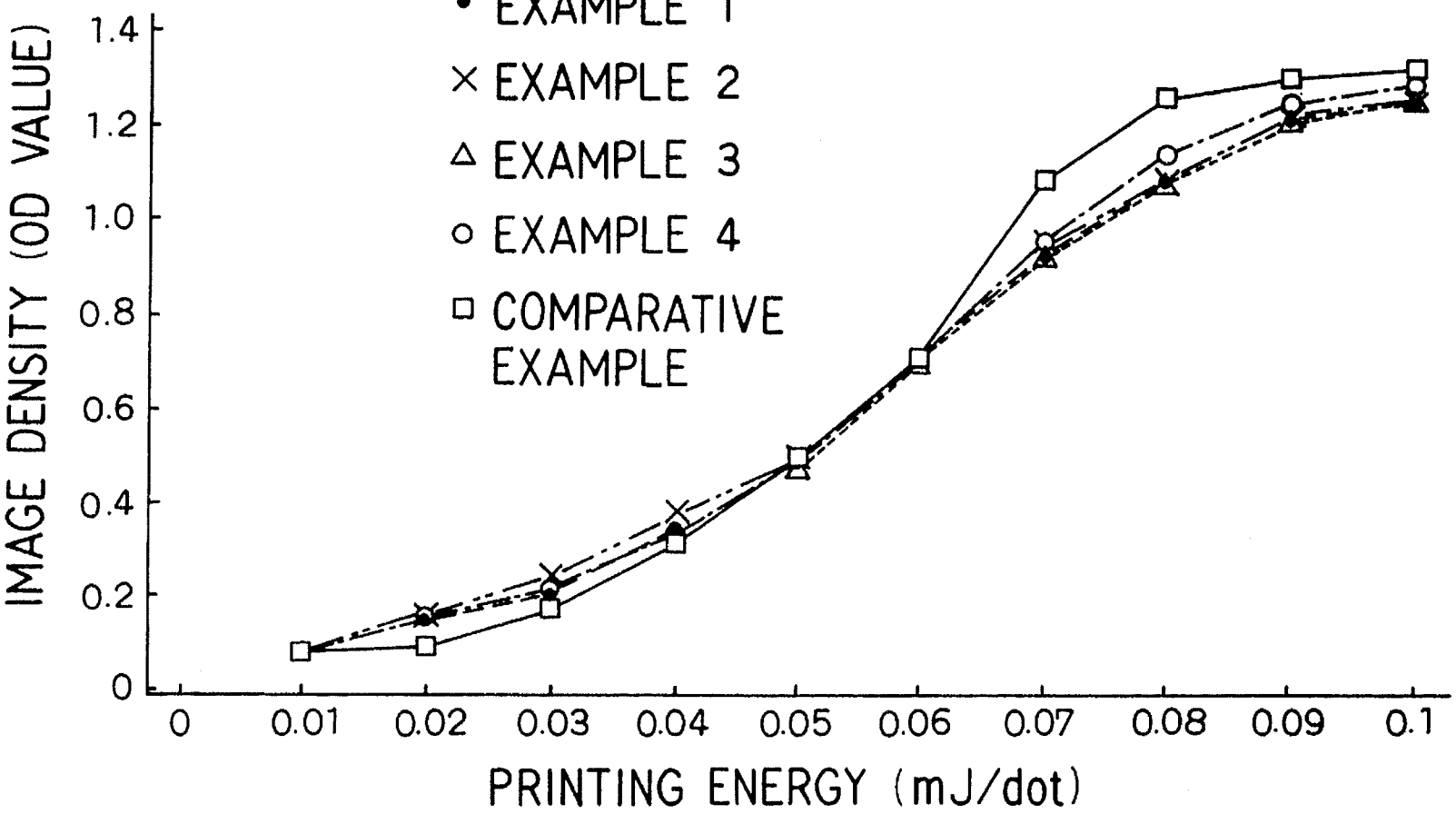
FIG. 11 is a graph showing a relationship between printing energy and optical reflection density with respect to the images obtained by using the thermal transfer media of Examples 1 to 4 and Comparative Example.

Thermal transfer printer: TRUEPRINT 2200 made by Victor Company of Japan, Limited, thermal head: 300 dots/inch Porous surface receptor: SPU-145XEW made by NISSHINBO INDUSTRIES, INC., average pore diameter: 1.0 μm average pore depth: 8 μm average pore density: $6\times10^5/mm^2$ (1) Gradation Quality With respect to each color, one-dot printing was conducted while increasing the printing energy by 0.01 mJ/dot within the range of 0.01 to 0.1 mJ/dot. The optical reflection density (OD value) of the thus obtained images was measured and a relationship between the printing energy and the optical reflection density was determined. The results are shown in FIG. 11. Each curve of the graph shown in FIG. 11 was obtained by plotting an average value of the respective values for the yellow, magenta and cyan images. The nearer to a straight line the curve is, the better the gradation quality is. (2) Resolution With respect to each color, one dot-line was printed every other one dot-line at a printing speed of 0.8 inch/second and a printing energy of 0.1 mJ/dot and the width of the obtained one-dot line was determined. The results are shown in Table 3. Each value shown in Table 3 is an average value of the respective values for the yellow, magenta and cyan lines. The nearer the line width is to the width (0.09 ram) of the line obtained on a heat-sensitive paper by printing under the same conditions as above, the higher the resolution is.

TABLE 3

| | Ex. 1 | Ex. 2 | Ex. 3 | Ex. 4 | Com. Ex |
|---|---|---|---|---|---|
| Line width (mm.) | 0.11 | 0.10 | 0.10 | 0.11 | 0.12 |

In addition to the materials and ingredients used in the Examples, other materials and ingredients can be used in the Examples as set forth in the specification to obtain substantially the same results.

As described above, in the case of forming a color image on the porous surface receptor with use of the thermal transfer medium of the present invention, the ink in the heated portion is peeled off from the thermal transfer medium at the interface between the ink layer and the receptor because of the strong adhesion of the ink layer to the undercoat layer when the thermal transfer medium is separated from the receptor, so that without disadvantages such as the excess transfer and uneven gloss, a predetermined amount of the ink is sure to enter the micropores and an ink image composed of ink dots with uniform gloss is obtained. Thus there is obtained a highly fine color image with excellent gradation quality and resolution. Further, predetermined amounts of different color inks can be superimposed in the respective micropores. This, coupled with the excellent gradation quality, provides a highly fine color image with excellent color reproducibility.

What is claimed is:

1. A thermal transfer medium for use in a method for forming a color image comprising selectively melt-transferring at least two of a yellow heat-meltable ink layer, a magenta heat-meltable ink layer or a cyan heat-meltable layer onto a receptor, said receptor having a microporous surface layer, in a predetermined order and each ink entering into micropores of the receptor in a molten state, thereby forming a color image, said color image comprising at least one color region developed on the basis of subtractive color mixture of at least two of yellow, magenta and cyan, or a combination of said color region with at least one color region of single color selected from yellow, magenta and cyan, the thermal transfer medium comprising a foundation, a non-transferable undercoat layer provided on the foundation, and at least one of a yellow heat-meltable ink layer, a magenta heat-meltable ink layer and a cyan heat-meltable ink layer provided on the undercoat layer, each of the ink layers comprising a coloring agent and a vehicle comprising a wax as a major ingredient, each of the ink layers having a melt viscosity of 20 to 200 cps/90° C., the undercoat layer consisting essentially of a resin exhibiting a strong adhesion to a wax or a mixture of a resin exhibiting a strong adhesion to a wax and filler.

2. The thermal transfer medium of claim 1, wherein the resin of the undercoat layer is at least one of a polyurethane resin and a polyamide resin.

3. The thermal transfer medium of claim 1 wherein the undercoat layer comprises a filler in the amount of 15 to 35% by weight.

4. The thermal transfer medium of claim 1, wherein the yellow heat-meltable ink layer, the magenta heat-meltable ink layer and the cyan heat-meltable ink layer are disposed in a side-by-side relationship on the foundation.

5. The thermal transfer medium of claim 4, wherein the yellow heat-meltable ink layer, the magenta heat-meltable ink layer and the cyan heat-meltable ink layer are periodically repeatedly disposed in a side-by-side relationship on the foundation in a repeating unit comprising the yellow, magenta and cyan heat-meltable ink layers arranged in a predetermined order.

6. An assembly of plural thermal transfer media for use in a method for forming a color image comprising selectively melt-transferring at least two of a yellow heat-meltable ink layer, a magenta heat-meltable ink layer or a cyan heat-meltable layer onto a receptor, said receptor having a microporous surface layer, in a predetermined order and each ink entering into the micropores of the receptor in a molten state, thereby forming a color image, said color image comprising at least one color region developed on the basis of subtractive color mixture of at least two of yellow, magenta and cyan, or a combination of said color region with at least one color region of single color selected from yellow, magenta and cyan, the assembly comprising a first thermal transfer medium comprising a first foundation, a first non-transferable undercoat layer provided on said first foundation, and a yellow heat-meltable ink layer provided on said first undercoat layer, a second thermal transfer medium comprising a second foundation, a second non-transferable undercoat layer provided on said second foundation, and a magenta heat-meltable ink layer provided on said second undercoat layer, and a third thermal transfer medium comprising a third foundation, a third non-transferable undercoat layer provided on said third foundation, and a cyan heat-meltable ink layer provided on said third undercoat layer, each of the ink layers comprising a coloring agent and a vehicle comprising a wax as a major ingredient, each of the ink layers having a melt viscosity of 20 to 200 cps/90° C., and each of the undercoat layers consisting essentially of a resin exhibiting a strong adhesion to a wax or a mixture of a resin exhibiting a strong adhesion to a wax and a filler.

7. The thermal transfer medium of claim 6, wherein the resin of the undercoat layer is at least one of a polyurethane resin and a polyamide resin.

8. The thermal transfer medium of claim 6 wherein each of the undercoat layers comprise a filler in the amount of 15 to 35% by weight.

9. A method for forming a color image comprising the steps of:

providing a thermal transfer medium comprising a foundation, a non-transferable undercoat layer provided on the foundation, and a yellow heat-meltable ink layer, a magenta heat-meltable ink layer and a cyan heat-meltable ink layer provided on the undercoat layer, each of the ink layers comprising a coloring agent and a vehicle comprising a wax as a major ingredient, each of the ink layers having a melt viscosity of 20 to 200 cps/90° C., the undercoat layer consisting essentially of a resin exhibiting a strong adhesion to a wax, or a mixture of a resin exhibiting a strong adhesion to a wax and a filler, selectively melt-transferring at least two of the ink layers onto a receptor, said receptor having a microporous surface layer, in a predetermined order and each ink entering into the micropores of the receptor in a molten state, thereby forming a color image, said color image comprising at least one color region developed on the basis of subtractive color mixture of at least two of yellow, magenta and cyan, or a combination of said color region with at least one single color region of yellow, magenta or cyan.

* * * * *

UNITED STATES PATENT AND TRADEMARK OFFICE

CERTIFICATE OF CORRECTION

PATENT NO : 5,597,641

DATED : January 28, 1997

INVENTION(S) : THERMAL TRANSFER MEDIUM

It is certified that error appears in the above-identified patent and that said Letters Patent are hereby corrected as shown below:

Column 1, line 7 after "heat-meltable" insert -- inks onto --.

Column 2, line 46 delete "in a" and substitute therefor -- layer --.

Column 2, line 47 after "layer" and insert -- in a --.

Column 3, line 28 after "as a" insert -- major --.

Column 3, line 62 delete "sectioned" and substitute therefor -- sectional --.

Column 5, line 37 delete "polyesterpolyether" and substitute therefor -- polyester-polyether --.

Column 6, line 34 after "mer," insert -- isoprene polymer, chloroprene --.

Column 7, line 18 delete second occurrence of "such as".

Column 8, line 24 after "with the" insert -- undercoat layer being --.

UNITED STATES PATENT AND TRADEMARK OFFICE

CERTIFICATE OF CORRECTION

PATENT NO. : 5,597,641

DATED : January 28, 1997

INVENTOR(S) : THERMAL TRANSFER MEDIUM

It is certified that error appears in the above-identified patent and that said Letters Patent is hereby corrected as shown below:

Column 8, line 25 delete "undercoat layer being."

Column 9, line 28 delete "mount" and substitute therefor -- amount --.

Column 12, line 18 after "meltable" insert -- ink --.

Signed and Sealed this

Twenty-fourth Day of October, 2000

*Attest:*

*Attesting Officer*

Q. TODD DICKINSON

*Director of Patents and Trademarks*